US010141139B2

(12) United States Patent
Burnel et al.

(10) Patent No.: US 10,141,139 B2
(45) Date of Patent: Nov. 27, 2018

(54) MULTIPLE POSITION ELECTRICAL SWITCH

(71) Applicant: C&K COMPONENTS S.A.S., Dole (FR)

(72) Inventors: Thierry Burnel, Dole (FR); Eric Riffaud, Besançon (FR)

(73) Assignee: C&K Components S.A.S., Dole (FR)

( * ) Notice: Subject to any disclaimer, the term of this patent is extended or adjusted under 35 U.S.C. 154(b) by 0 days.

(21) Appl. No.: 15/638,521

(22) Filed: Jun. 30, 2017

(65) Prior Publication Data

US 2018/0005782 A1 Jan. 4, 2018

(30) Foreign Application Priority Data

Jun. 30, 2016 (FR) ..... 16 56208

(51) Int. Cl.

| | |
|---|---|
| ***H01H 25/00*** | (2006.01) |
| ***G05G 9/02*** | (2006.01) |
| ***H01H 11/06*** | (2006.01) |
| ***H01H 25/04*** | (2006.01) |
| ***H01H 13/40*** | (2006.01) |
| *H01H 1/26* | (2006.01) |

(52) U.S. Cl.

CPC ..... *H01H 25/006* (2013.01); *G05G 9/02* (2013.01); *H01H 11/06* (2013.01); *H01H 13/40* (2013.01); *H01H 25/041* (2013.01); *H01H 2001/265* (2013.01); *H01H 2025/046* (2013.01); *H01H 2300/008* (2013.01)

(58) Field of Classification Search

CPC .... H01H 25/006; H01H 11/06; H01H 25/041; H01H 2300/008; H01H 23/025; H01H 23/00; H01H 2300/01; G05G 9/02

USPC ..... 200/5 R, 6 B, 6 R, 315, 339, 408, 459

See application file for complete search history.

(56) References Cited

U.S. PATENT DOCUMENTS

| | | | | | |
|---|---|---|---|---|---|
| 4,107,482 | A * | 8/1978 | Marker | H01H 19/62 | 200/11 R |
| 4,382,166 | A | 5/1983 | Kim | | |
| 4,436,971 | A | 3/1984 | Kim | | |
| 5,089,715 | A | 2/1992 | Kokubu | | |
| 5,227,594 | A * | 7/1993 | Russo | H01H 25/041 | 200/6 A |
| 5,359,164 | A * | 10/1994 | Kucharski, Jr. | H01H 23/025 | 200/243 |
| 5,510,810 | A * | 4/1996 | Nishijima | G05G 9/047 | 345/156 |
| 5,675,359 | A * | 10/1997 | Anderson | G05G 9/047 | 200/6 R |

OTHER PUBLICATIONS

Search Report dated Feb. 7, 2017 in connection with Franch Patent Application No. 1656208.

* cited by examiner

*Primary Examiner* — Edwin A. Leon

(74) *Attorney, Agent, or Firm* — Fox Rothschild LLP

(57) ABSTRACT

An electrical switch includes a fixed upper contact, a fixed lower contact, and a mobile contact blade. A fixed support bears the mobile contact blade, and the fixed support includes a front support branch and a rear support branch. Each branch includes a transversely-oriented horizontal notch, in the bottom of which is housed a transverse free edge of a respective front and rear section of the mobile contact blade. The fixed support includes two identical support plates spaced transversely apart.

10 Claims, 7 Drawing Sheets

MULTIPLE POSITION ELECTRICAL SWITCH

RELATED APPLICATIONS AND CLAIM OF PRIORITY

This patent document claims priority to France Patent Application number 1656208, filed Jun. 30, 2016, titled "Multiple Positions Electrical Switch." The disclosure of the priority application is fully incorporated into this document by reference.

BACKGROUND

This patent document relates to a multiple position electrical switch. Such a type of switch may be, for example, used on board a motor vehicle to control the supply of electrical power to a motor actuating an accessory or an equipment item such as, for example, a seat adjustment motor.

As is known, such a switch is required to provide its user with a tactile sensation of the changes in switching state.

Examples of multiple position electrical switches are described in U.S. Pat. Nos. 4,382,166 and 4,436,971, which teach that it is known practice for the actuating means that act on a mobile contact blade to comprise an intermediate force transmitting lever which is mounted so as to pivot with respect to a casing and which is interposed between the actuating member and the mobile contact blade so as to transmit, to part of the mobile contact blade, the actuating force which is applied to it by the actuating member.

Another example of such a switch is disclosed in U.S. Pat. No. 5,089,715, in which the U-section fixed support bearing the blade is a one-piece component made of metal cut from a thick plate and bent. Because of this design, the dimensional variations on the fixed support in mass manufacture and in operation do make it possible reliably to obtain performance and operating conditions that are repeatable from one switch to another and/or during use. This is notably because of the forces that the mobile contact blade applies to it.

The disclosure of each of the patents listed above are fully incorporated into this document by reference.

SUMMARY

In an embodiment, an electrical switch that include: a casing made of insulating material; a fixed upper contact and a fixed lower contact which are vertically opposed; a mobile contact blade which is elastically deformable between two switching states in each of which a contact part of the blade is in electrical contact with the fixed lower contact or with the fixed upper contact respectively; a fixed support which bears the mobile contact blade and which comprises a vertical front support branch and a vertical rear support branch which are spaced apart longitudinally and of which each comprises a transversely oriented horizontal notch, respectively a front and rear notch, (notably with a V-shaped profile) in the bottom of which is housed a transverse free edge of a respectively front and rear section of the mobile contact blade; and an actuator which collaborates with a part of the mobile contact blade to bring about a change in switching state.

In an embodiment, an electrical switch of the type mentioned above is characterized in that the fixed support includes two parallel vertical support plates spaced transversely apart. Each of the vertical support plates may include a vertical front support branch and a vertical rear support branch which are spaced apart longitudinally and of which each comprises a transversely oriented respectively front and rear horizontal notch in the bottom of which is housed a portion of the said transverse free edge of a respectively front and rear section of the mobile contact blade.

According to certain embodiments: the two front and rear support branches may be connected by a longitudinally oriented bottom horizontal connecting branch. At least one support branch may be electrically connected to an electrical connection terminal borne by the casing; the two support plates are identical. The actuator may include an actuating member which is mounted so as to toggle, with respect to the casing, between an upper rest position to which it is elastically returned and in which the contact part of the mobile contact blade is in electrical contact with the upper fixed contact and a lower actuating position causing the contact part to come into electrical contact with the fixed lower contact. The actuator also may include a force transmitting lever which is mounted to pivot with respect to the casing and which is interposed between the actuating member and the mobile contact blade so as to transmit to the mobile contact blade the actuating force that is applied to it by the actuating member. A compression spring may be interposed between the actuating member and the force transmitting lever. The compression spring may be a block made of an elastically compressible material, such as synthetic rubber or other types of rubber. The actuating member may include an actuating arm, which extends in the plane of toggling of the actuating member. The compression spring may be interposed between one end of the actuating arm and the force transmitting lever. The compression spring may be borne by the force transmitting lever.

BRIEF DESCRIPTION OF THE FIGURES

Further features and advantages of the invention will become apparent during a reading of the detailed description which follows, for the understanding of which reference will be made to the attached drawings in which.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

In the remainder of the description, elements exhibiting an identical structure or analogous functions will be denoted by the same references.

In the remainder of the description, longitudinal, vertical (without reference to the earth's gravitational field) and transverse orientations indicated by the "L, V, T" trihedron in the figures will be adopted in a nonlimiting manner. A horizontal plane is also defined which extends longitudinally and transversely.

The longitudinal axis "L" is oriented from back to front.

In the description which follows, elements and components that are identical, analogous or similar will be denoted by the same numerical and/or alphanumerical references.

Figure 3:
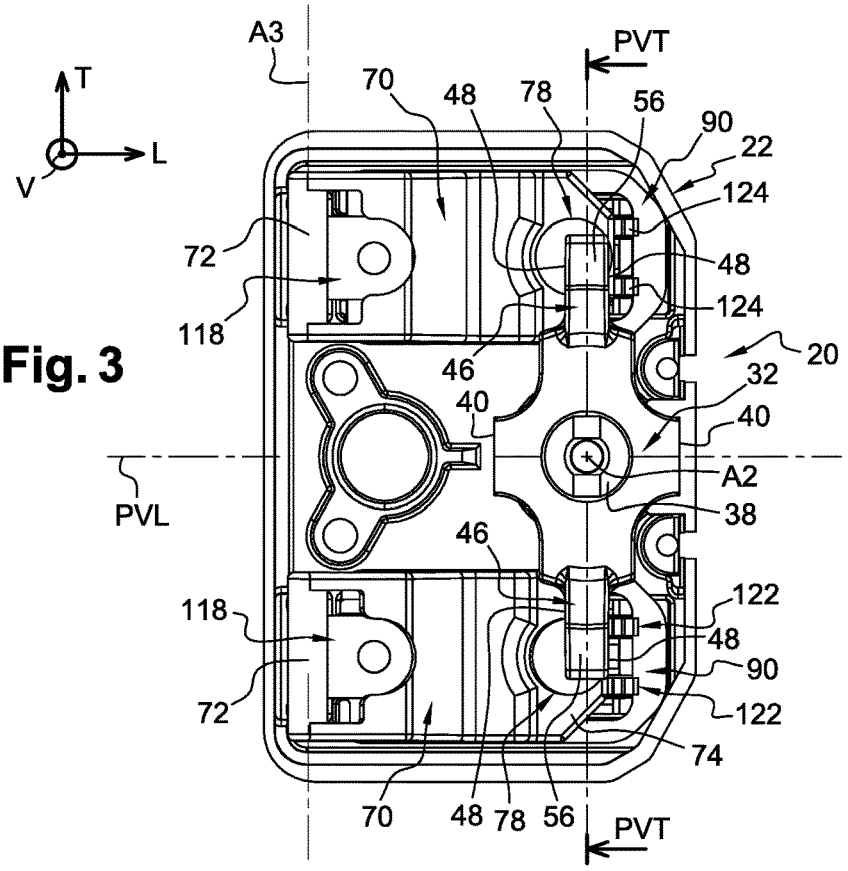
FIG. 3 is a view of the switch of FIG. 1A from above.

The switch depicted in FIGS. 1A to 12 exhibits symmetry of design with respect to a vertical and longitudinal plane of symmetry PVL indicated in FIG. 3.

Figure 4:
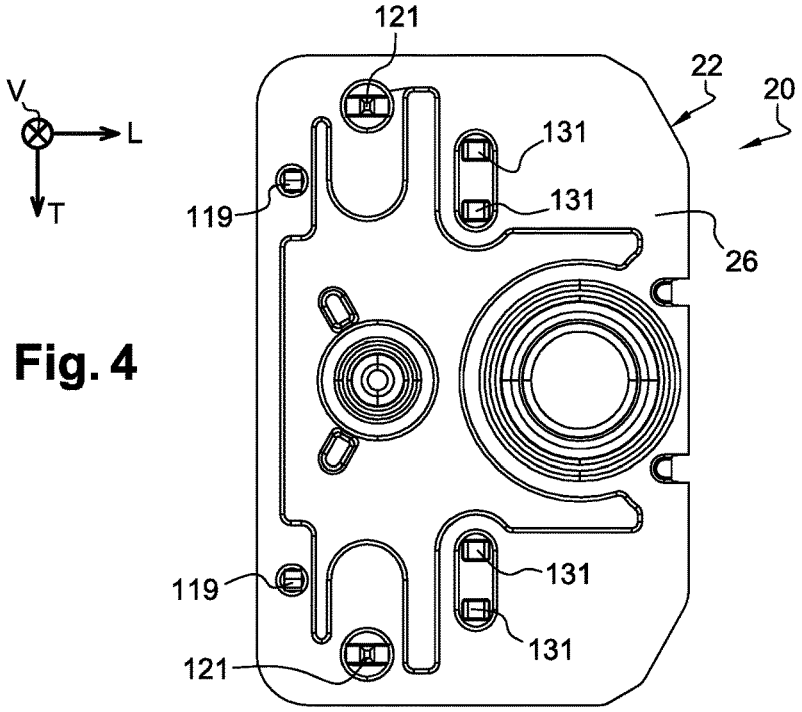
FIG. 4 is a view of the switch of FIG. 1A from beneath.
Figure 5:
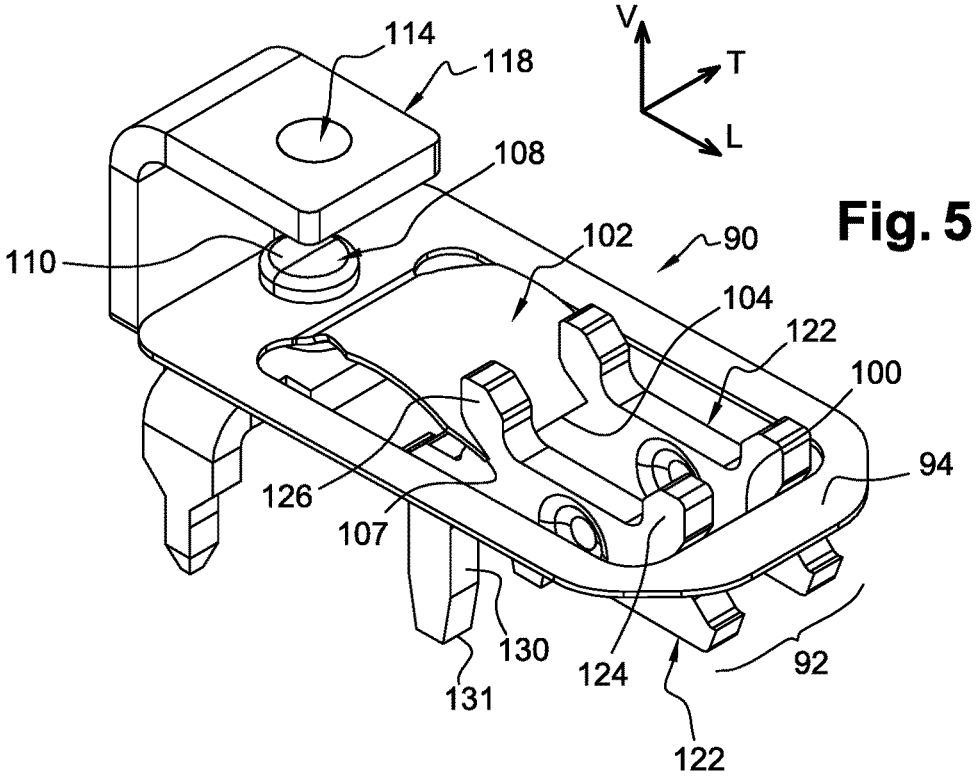
FIG. 5 is a perspective view illustrating a subassembly comprising a pair of fixed, upper and lower, contacts, the associated mobile contact blade illustrated in a lower position of electrical contact with the fixed lower contact, and a fixed support of the mobile contact blade which is produced in two parts.
Figure 6:
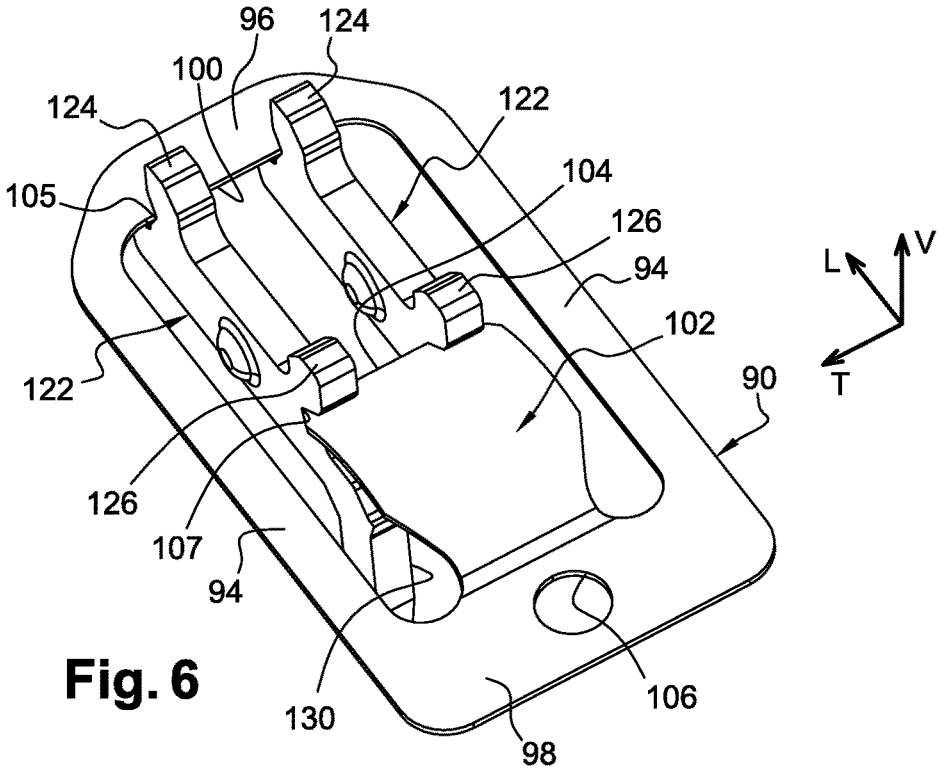
FIG. 6 is a view of some of the components of FIG. 5, illustrated from another angle of perspective.

Thus, in the case of "duplicate" components arranged symmetrically with respect to the plane PVL, only those corresponding to the left-hand half of FIGS. 3 and 4, namely to the lower half of FIG. 3, will be described in detail here.

Figure 1A:
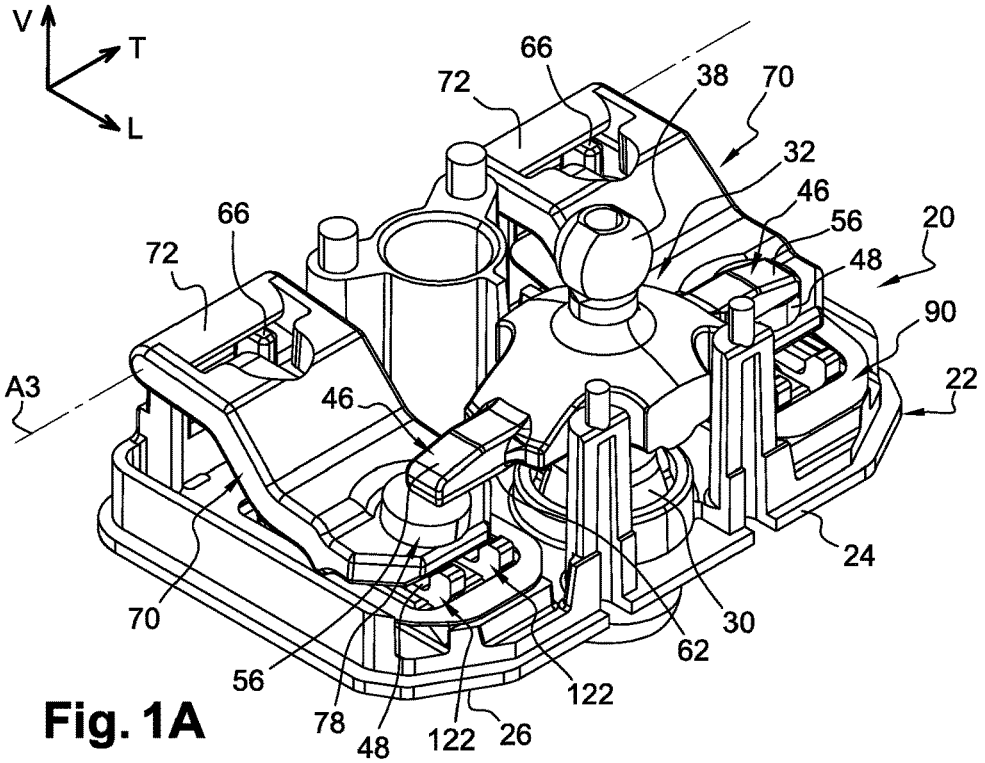
FIG. 1A is a perspective view of certain components of a first embodiment of an electric switch, with two switching paths and an actuator that toggles, and which is depicted without its upper casing cover.
Figure 1B:
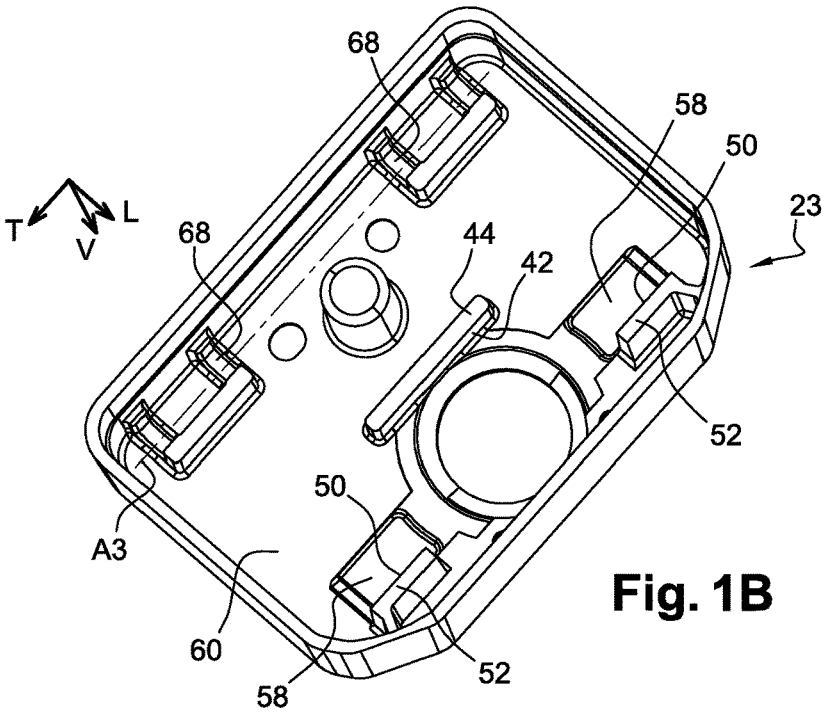
FIG. 1B is a perspective view from beneath of the upper casing cover of the switch of FIG. 1A.
Figure 2:
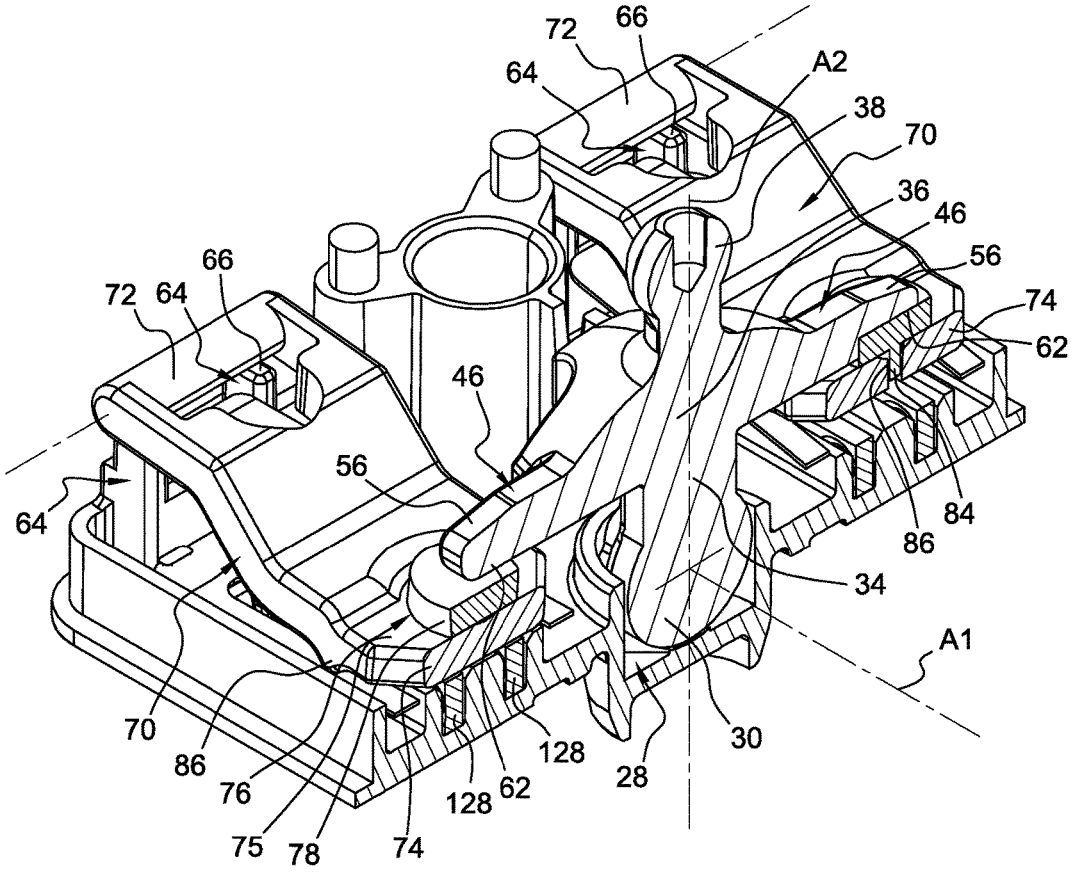
FIG. 2 is a view similar to that of FIG. 1A, in which part has been cut away on a vertical and transverse plane PVT passing through the plane of toggling of the actuator.

FIGS. 1A to 4 depict an electric switch 20 comprising a casing made up of a lower base 22 made of an electrically insulating moulded plastic and of a complementary upper cover 23 (depicted in FIG. 1B).

The lower base 22 comprises a lower plate 24 which is delimited by a horizontal planar lower face 26 which is, for example, able to rest on and be fixed to an upper face of a printed circuit board, not depicted.

The lower base 22 comprises a concave hemispherical housing 28 which is centred and arranged at the front and open towards the top to accept a complementary convex spherical lower part 30 of an actuator 32.

Aside from the articulation lower part 30, the actuator 32 may include a vertical stem 34, an upper body 36 and a manipulating upper end 38.

The upper body 36 may be delimited longitudinally by two parallel transverse and vertical flats 40 of which the rear one is guided in sliding along an opposing vertical and transverse internal face 42 formed on a wing 44 inside the cover 23 so as to guide the actuator 32 as it toggles in a vertical and transverse plane parallel to the plane PVT, which means to say as it pivots about the longitudinal lower axis A1 that passes through the centre of the complementary convex spherical lower articulation part 30.

The upper body may include two transversely oriented actuating arms 46 which are diametrically opposed with respect to the vertical axis A2 of the stem 34.

Each arm 46 is delimited longitudinally by two vertical and transverse faces 48 of which the front one is guided in sliding along a vertical internal face of the cover 23 in a vertical and transverse plane parallel to the plane PVT.

Each transverse arm 46 may include on its upper face and in the vicinity of its free end an inclined stop face 56 which, depending on the angular position of the actuator with respect to the casing is able to collaborate with a stop surface 58 formed opposite in the internal horizontal face 60 of the cover 23 so as to define the two maximum and opposite angular positions of toggling of the actuator 32 in one direction or the other about the axis A1.

Each transverse arm 46 may be delimited vertically towards the bottom by a horizontal actuating surface 62 which, in the vicinity of the free end of the associated arm, is able to collaborate with an associated force transmitting lever 70 as will be described later on.

For the purposes of mounting and guiding the pivoting movement of each of the two force transmitting levers 70, the base 22 may include two pairs of rear vertical fins 64, each of which is delimited by a horizontal bearing facet 66.

In the vicinity of its rear transverse edge, the cover 23 may include, on the inside, two concave semicylindrical horizontal and transverse housings 68 which are aligned along an axis A3 of pivoting.

In some embodiments, each force transmitting lever 70 may be a molded plastic or otherwise formed component which, in the vicinity of its rear longitudinal end, comprises a pivot shaft 72 which is housed in a complementary housing 68 in which it is held in position by the facets 66 which collaborate with the convex surface of the shaft 72.

Thus, each force transmission lever 70 may be mounted with the ability to pivot in both directions about the horizontal transverse geometric axis A3 situated in the vicinity of the rear transverse face of the lower base 22.

Each force transmitting lever 70 comprises a free front end section 74 which extends horizontally under an actuating horizontal surface 62 of an associated transverse actuating arm 46 of the actuator 32.

Thus, the free front end section 74 of each force transmitting arm 70 constitutes the zone at which the actuating force is applied by the actuator 32 to the lever.

Each actuating arm 46 acts on a force transmitting lever 70, in this instance indirectly with the vertical interposition of an element 76 that forms a compression spring.

By way of nonlimiting example, each compression spring 76 is made here of an upper block 78 of elastically compressible material, for example of natural or synthetic rubber.

Each compression spring 76 may be made up of a cylindrical upper block 78, of vertical overall axis, which is delimited by a lower face 80 which bears against a portion of the opposing upper face 75 of the free end section 74 of the force transmitting lever 70 bearing it, and is also delimited by a free upper face 82 which is able to collaborate with the opposing portion of the actuating surface 62 of the associated actuating arm 46.

Each block that forms a compression spring 76 may be mounted slightly vertically compressed between the associated surfaces 62 and 75 and is able to be elastically compressed between the surfaces 62 and 75.

Each block that forms a compression spring 76 is borne by the free end section 74 to which it is fixed, in this instance via a cylindrical lower section 84 acting as a fixing pin which is pushed elastically into a complementary hole 86 formed in the front free end section 74.

Between its geometric axis of articulation and of pivoting A3 and its front free end section 74, each force transmitting lever 70 may include, on its lower face 71, a transverse rib 86 produced in two opposite sections each of which is arranged near one vertical transverse lateral face of the force transmitting arm 70.

Figure 8:
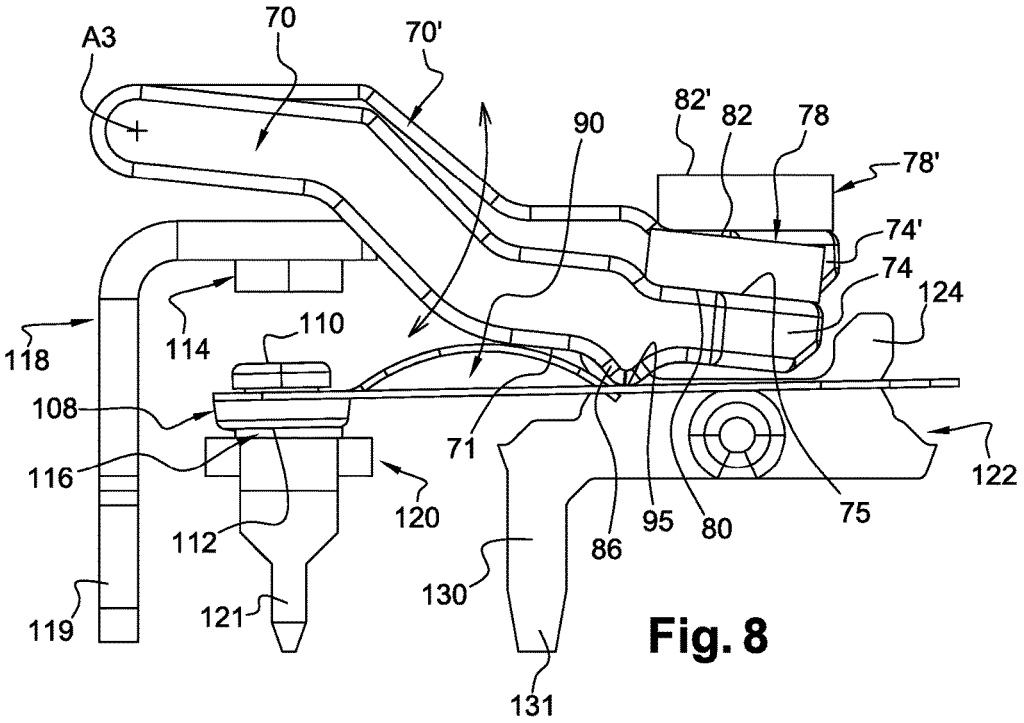
FIG. 8 is a view similar to that of FIG. 7 also depicting the associated force transmitting lever in the lower position, with the upper position shown in the background.
Figure 9:
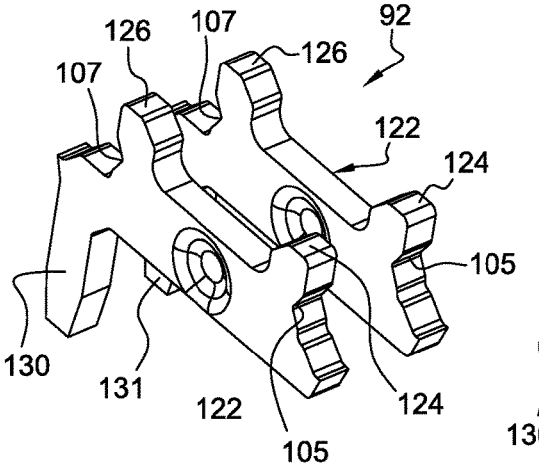
FIG. 9 is a perspective view of the two identical plates that can make up a support according to an embodiment for a mobile contact blade.
Figure 10:
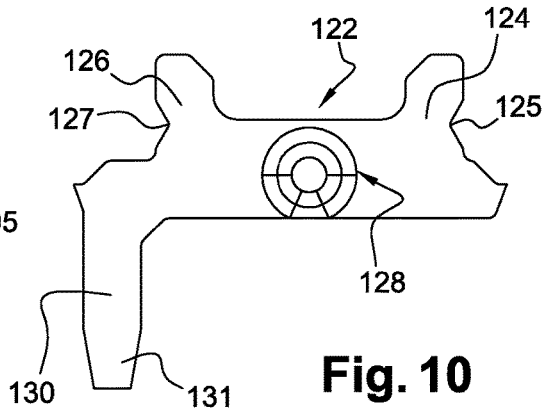
FIG. 10 is a side view from the left of one of the two plates illustrated in FIG. 9.

As can be seen from FIG. 8, each force transmitting arm 70 may have a curved profile such that its front and rear free end sections extend in planes that are substantially parallel but vertically offset from one another, and such that the lower rib 86 for applying force to an associated mobile contact blade 90 may be offset vertically downwards with respect to the axis A3.

The lower rib 86 may extend longitudinally between the axis A3 of pivoting of the force transmitting lever 70 and the mean point of application of an actuating force to the lever 70 by the associated transverse arm 46 which can be considered as corresponding to the vertical axis of the block 78 that forms the compression spring 76.

Via its lower rib 86, each force transmitting lever 70 may collaborate with a mobile contact blade 90 which is borne on the lower base 22 by a fixed support 92.

Figure 11:
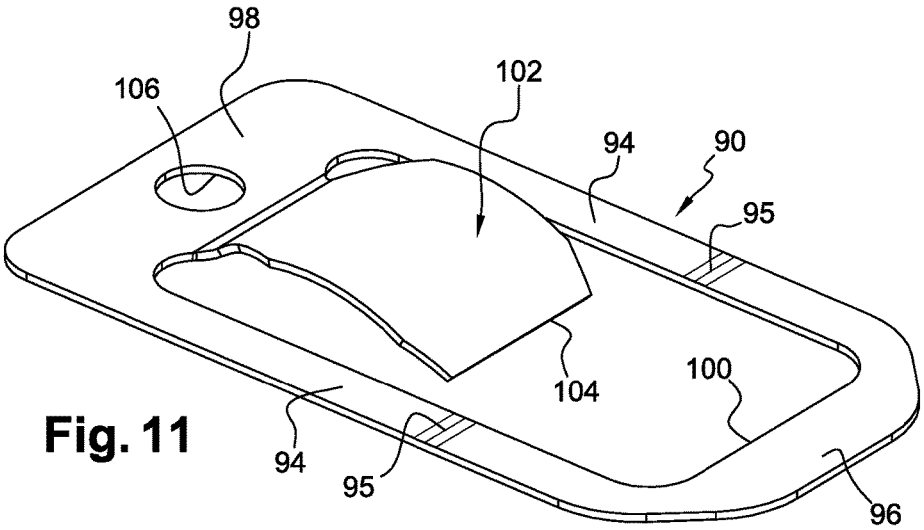
FIG. 11 is a perspective view of a mobile contact blade.
Figure 12:
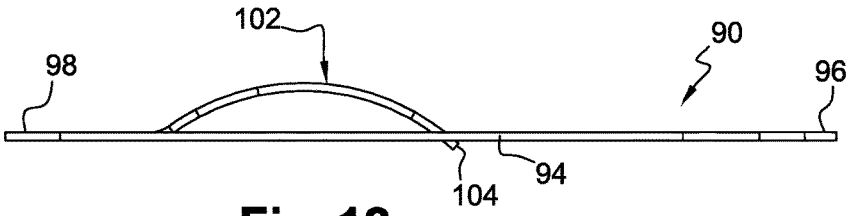
FIG. 12 is a side view from the left of the mobile contact blade depicted in FIG. 11.

As can be seen in detail in FIGS. 11 and 12, the mobile contact blade 90 may be an electrically conducting metal plate which is produced by processes such as cutting and bending and which has the overall shape of a rectangular frame made up of two horizontal longitudinal branches 94, of a horizontal front transverse branch 96 and of a horizontal rear transverse branch 98.

The front transverse branch 96 may be delimited towards the inside by a free transverse edge 100.

In the open central zone of the frame, the mobile contact blade 90 may include a bent central branch 102 the convexity of which faces upwards and which is delimited towards the inside by a rear transverse edge 104.

The rear transverse branch 98 may include, in its middle, a hole 106 in which is mounted an electrically conducting contact pad 108 which is delimited by an upper contact face 110 and by a lower contact face 112.

When the mobile contact blade 90 is in the mounted position, the mobile contact pad 108 may be arranged vertically between two fixed contacts, respectively an upper contact 114 and a lower contact 116, each of which here likewise takes the form of an electrically conducting pad.

The fixed upper contact 114 may be borne by a pin 118 bent over at approximately 90 degrees which is inserted into the lower base 22 and the lower end section 119 of which projects vertically downwards beyond the lower face 26 of the lower base 22 to constitute an electrical connection terminal for the fixed upper contact 114.

In the same way, the fixed contact 116 may be a conducting pad borne by a curved pin 120 the lower edge section 121 of which constitutes an electrical connection terminal for the fixed lower contact 116.

With the mobile contact blade 90, each mobile contact pad 108 may be thus mounted with the ability to move vertically between the two fixed, upper 114 and lower 116, contacts, with each of which, in the known way, the mobile contact blade 90 is able to collaborate alternately depending on the state of elastic deformation of the mobile contact blade.

The fixed support 92 of the mobile contact blade 90 may be made up of two identical fixed support plates 122 which are spaced transversely apart.

The two plates 122 are, here, by way of nonlimiting example, identical and each is produced by cutting from a thick metal plate.

Each fixed support plate 122 extends in a vertical and longitudinal plane and each may include a vertical front support branch 124 and a vertical rear support branch 126 which are connected to one another by a bottom horizontal branch 128 from which the branches 124 and 126 extend.

Each fixed vertical support plate 122 also may include, in the vicinity of its rear longitudinal end, a lower vertical branch 130 for fixing to the lower base 22, the lower free end section 131 of which brunch constitutes an electrical connection terminal for the fixed vertical support plate 122 and therefore for the mobile contact blade 90 that it bears.

The front support branch 124 may include a horizontal notch 125 with a V-shaped profile which houses an associated portion of the front transverse edge 100 of the front transverse branch 94 of the mobile contact blade 90.

In the same way, the rear support branch 126 may include a transversely oriented horizontal notch 127 with a V-shaped profile in the bottom of which is housed an associated portion of the rear free transverse edge 104 of the bent branch 102 of the mobile contact blade 90.

Creating each fixed support plate 122, and therefore the fixed support 92, by cutting from a thick plate gives it good rigidity ensuring durable constancy of the dimensions of the fixed support, and notably of the spatial geometry of the two notches 125 and 127.

The cover 23 may include wings 52 on the inside, these being delimited by faces 50, to ensure that the plates 122 are held in position.

In the known way, each mobile contact blade 90 may be mounted under elastic load (in a support 92 made up of two fixed support plates 122) by elastic deformation of the bent branch 102 and insertion of the free edges 100 and 104 in their associated notches 105 and 107 respectively.

The normal rest position of the mobile contact blade 90 in this instance is an "upper" position corresponding to a switching state said to be at rest, in which the mobile contact pad presses against and is in electrical contact with the upper fixed contact 114, thus establishing a closed (made) electrical connection between the connection terminal 119 and the connection terminals 131.

Figure 7:
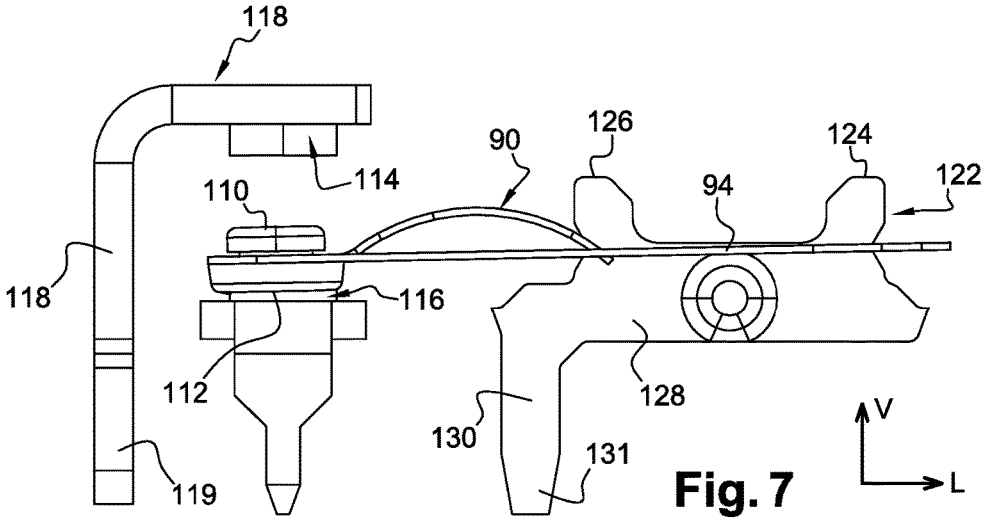
FIG. 7 is a side view from the left of the subassembly depicted in FIG. 3.

To bring about a change in switching state of a mobile contact blade 90 from its upper rest position, in order to reach the switching state illustrated notably in FIGS. 7 and 8, elastic deformation of the mobile contact blade 90 has to be brought about, in this instance by acting vertically downwards on two zones 95 (see FIG. 11) of the upper face of the longitudinal branches 94.

The force to elastically deform the mobile contact blade 90 is in this instance exerted on the zones 95 by the rib sections 86 of the associated force transmitting lever 70.

FIG. 8 depicts the force transmitting lever 70 pivoted into the lower position corresponding to the change in switching state of the mobile contact blade 90 thus establishing contact between the mobile contact pad 108 and the lower fixed contact 116 and thus establishing a closed (made) electrical connection between the connection terminals 121 and 131, after having opened (broken) the electrical connection between the connection terminals 119 and 131.

The mobile contact blade 90 is kept in this state of elastic deformation and electrical switching as long as the force transmitting lever 70 is kept in the "lower" position depicted in FIG. 8 which also depicts the "upper" position 70' occupied by the transmission arm, for which position the reference numerals have a "prime" suffix.

In order to bring about the toggling, in the clockwise direction when considering FIG. 8, of a force transmitting lever 70 about the geometric axis A3, and therefore to bring about the deformation of the mobile contact blade 90, it is necessary to act in the corresponding direction on the actuator 32, the associated transverse arm 46 of which acts on the block 78 forming a compression spring and therefore indirectly on the front free end section 74.

The presence of the block 78 that forms a compression spring interposed between the transverse lever 46 and the front free end section 74 of the associated force transmitting lever 70 on the one hand serves to absorbing play and, on the other hand, serves to absorb force in the event of actuation overtravel because of its ability to be compressed vertically.

In the absence of mechanical action on the manipulating upper end 38 of the actuator 32, the latter is in a position referred to as the rest position in which the two opposing transverse arms 46 extend substantially horizontally, and in which the two mobile contact blades 90 are in their upper rest position establishing a route for electrical switching between the connection terminals 119 and 131.

When the contact blade 90 is actuated by elastic deformation, it may change state abruptly to give the user a tactile sensation of the change in state which is transmitted to the user mechanically via the actuator 32.

The interposition of a force transmitting lever 70 between the transverse arm 46 and the mobile contact blade 90 allows a design that is modular according to the actuating force and the desired sensitivity to triggering, notably by choosing, for the force transmitting lever 70, the longitudinal position of the rib sections 86 and of the point of application of the force by the transverse arm 46 relative to one another and each in relation to the axis of pivoting A3.

As has just been explained, the first embodiment—illustrated notably in FIGS. 1A to 4—is a switch with two switching routes, each of which is arranged symmetrically with respect to the plane of symmetry PVL.

Figure 13:
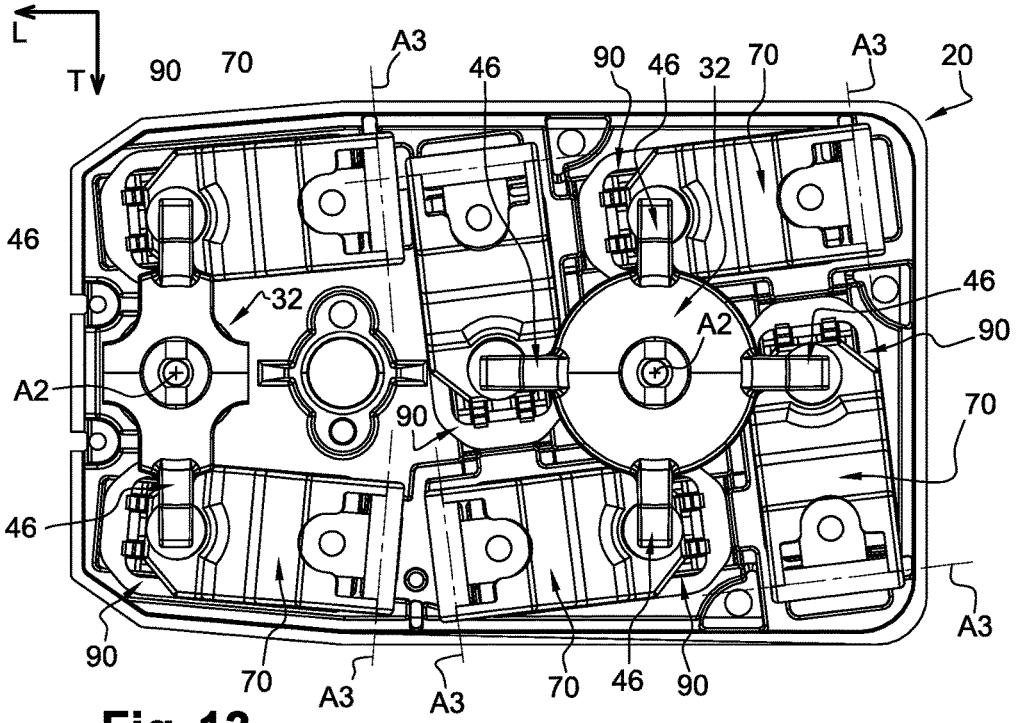
FIGS. 13 and 14 are views similar to those of FIGS. 3 and 4 illustrating a second embodiment of an electric switch with six switching paths and two actuators, which is depicted without its upper casing cover.
Figure 14:
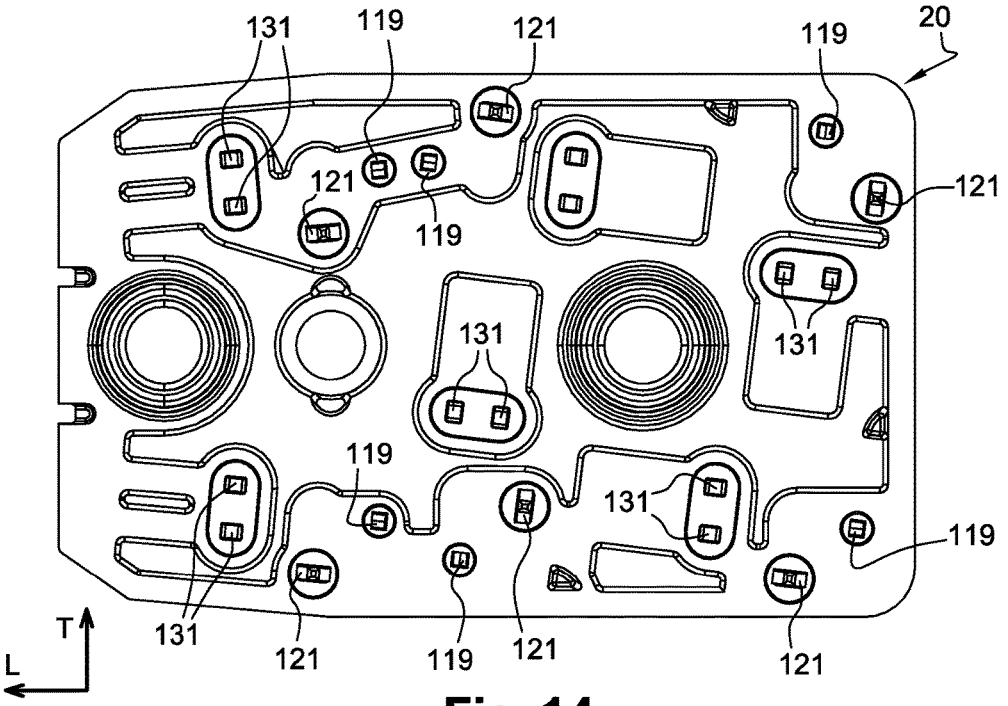

FIGS. 13 and 14 depict another embodiment of an electric switch 20 which, in its left-hand part when considering FIG. 13, incorporates a first subassembly with two switching routes similar to that of the first embodiment and comprising a first actuator 32 which is mounted to toggle in a transverse vertical plane.

On its right-hand part, the electric switch 20 may incorporate a second subassembly of similar design but comprising four switching routes each of which is similar in design to the one that has just been described previously, with the four switching routes set out in a "square" around a second actuator 32 which is mounted and able to toggle in two vertical planes, transverse and longitudinal respectively, depending on the plane of toggling, so as to be able to act via one or other of the two diametrically opposed actuating arms on one or other of two switching routes which are associated in pairs.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. An electrical switch comprising:

a casing made of insulating material;

a fixed upper contact and a fixed lower contact, wherein the fixed upper contact and the fixed lower contact are vertically opposed;

a mobile contact blade, wherein the mobile contact blade is elastically deformable between two switching states such that a contact part of the mobile contact blade is in electrical contact with the fixed lower contact or with the fixed upper contact, respectively;

a fixed support bearing the mobile contact blade, wherein the fixed support comprises two parallel vertical support plates spaced transversely apart from one another, further wherein each vertical support plate comprises a vertical front support branch and a vertical rear support branch spaced apart longitudinally from one another, and further wherein each of the vertical front support branch and the vertical rear support branch comprises a transversely oriented horizontal notch, in the bottom of which is housed a transverse free edge of a respective front and rear section of the mobile contact blade; and an actuator, wherein the actuator collaborates with a part of the mobile contact blade to bring about a change in switching state.

2. An electrical switch according to claim 1, wherein the front and rear support branches are connected by a longitudinally oriented bottom horizontal connecting branch.

3. An electrical switch according to claim 1, wherein at least one of the support branches is electrically connected to an electrical connection terminal borne by the casing.

4. An electrical switch according to claim 1, wherein the two vertical support plates are identical.

5. An electrical switch according to claim 1, wherein the actuator comprises an actuating member which mounted so as to toggle, with respect to the casing, between an upper rest position to which it the actuator is elastically returned and in which the contact part of the mobile contact blade is in electrical contact with the upper fixed contact and a lower actuating position causing the contact part to come into electrical contact with the fixed lower contact.

6. An electrical switch according to claim 5, wherein the actuator comprises a force transmitting lever, wherein the force transmitting lever is mounted to pivot with respect to the casing and is interposed between the actuating member and the mobile contact blade so as to transmit to the mobile contact blade the actuating force that is applied to the mobile contact blade by the actuating member.

7. An electrical switch according to claim 6, wherein a compression spring is interposed between the actuating member and the force transmitting lever.

8. An electrical switch according to claim 7, wherein the compression spring is a block made of an elastically compressible material.

9. An electrical switch according to claim 6, wherein the actuating member comprises an actuating arm, wherein the actuating arm extends in a plane of toggling of the actuating member, and further wherein the compression spring is interposed between one end of the actuating arm and the force transmitting lever.

10. An electrical switch according to claim 9, wherein the compression spring is borne by the force transmitting lever.

* * * * *